US008843390B2

(12) United States Patent
Kang et al.

(10) Patent No.: US 8,843,390 B2
(45) Date of Patent: Sep. 23, 2014

(54) MULTI-LANE FREE FLOW ELECTRONIC TOLL COLLECTION SYSTEM AND ON BOARD UNIT THEREOF

(75) Inventors: Po-Chun Kang, Chiayi County (TW); Tzu-Hsiang Su, Taichung County (TW); Ta-Yang Juan, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 785 days.

(21) Appl. No.: 12/904,165

(22) Filed: Oct. 14, 2010

(65) Prior Publication Data

US 2012/0059689 A1 Mar. 8, 2012

(30) Foreign Application Priority Data

Sep. 6, 2010 (TW) ..... 99130097 A

(51) Int. Cl.

| | |
|---|---|
| ***G07B 15/00*** | (2011.01) |
| ***G07B 15/02*** | (2011.01) |
| ***G08G 1/00*** | (2006.01) |
| ***G07B 15/06*** | (2011.01) |

(52) U.S. Cl.

CPC ..... *G07B 15/02* (2013.01); *G07B 15/063* (2013.01)

USPC ..... 705/13; 340/928

(58) Field of Classification Search

CPC ..... G07B 15/063; G08G 1/017

USPC ..... 235/384; 340/928, 905; 705/13

See application file for complete search history.

(56) References Cited

U.S. PATENT DOCUMENTS

| | | | | |
|---|---|---|---|---|
| 5,602,375 | A * | 2/1997 | Sunahara et al. | 235/384 |
| 6,140,941 | A * | 10/2000 | Dwyer et al. | 340/928 |
| 6,191,705 | B1 * | 2/2001 | Oomen et al. | 340/905 |
| 6,219,613 | B1 * | 4/2001 | Terrier et al. | 701/408 |
| 6,661,352 | B2 * | 12/2003 | Tiernay et al. | 340/928 |
| 7,233,260 | B2 * | 6/2007 | Tang et al. | 340/928 |
| 7,676,392 | B2 | 3/2010 | Hedley et al. | |
| 8,228,205 | B2 * | 7/2012 | Kohli et al. | 340/605 |
| 8,471,683 | B2 * | 6/2013 | Roesner | 340/10.4 |

(Continued)

FOREIGN PATENT DOCUMENTS

| | | |
|---|---|---|
| CN | 1427577 A | 7/2003 |
| CN | 101123456 A | 2/2008 |

(Continued)

OTHER PUBLICATIONS

Xu Guangxian, "The Research and Application of RFID Technologies in Highway's Electronic Toll Collection System", Wireless Communications, Networking and Mobile Computing 2008. WiCOM '08. 4th International Conference, 2008 IEEE, p. 1-p. 4.

(Continued)

*Primary Examiner* — Brian Epstein

(74) *Attorney, Agent, or Firm* — Jianq Chyun IP Office

(57) ABSTRACT

An electronic toll collection (ETC) system and an on board unit (OBU) thereof are provided. The ETC system includes a toll collection module and an identification module. The toll collection module provides a pre-pay service and a post-pay service such that the OBU on a vehicle can make a toll payment in response to one of the pre-pay service and the post-pay service. The identification module captures an image of the vehicle and provides an identification service to the OBU to obtain an identification information of the vehicle.

10 Claims, 5 Drawing Sheets

(56) References Cited

U.S. PATENT DOCUMENTS

| | | | | |
|---|---|---|---|---|
| 2003/0001755 | A1* | 1/2003 | Tiernay et al. | 340/928 |
| 2006/0071816 | A1* | 4/2006 | Tang et al. | 340/928 |
| 2006/0278705 | A1* | 12/2006 | Hedley et al. | 235/384 |
| 2008/0278347 | A1* | 11/2008 | Ho et al. | 340/928 |
| 2009/0184847 | A1* | 7/2009 | Kohli et al. | 340/989 |
| 2009/0231161 | A1 | 9/2009 | Malarky | |
| 2010/0274641 | A1* | 10/2010 | Allen et al. | 705/13 |

FOREIGN PATENT DOCUMENTS

| | | | |
|---|---|---|---|
| CN | 101739730 | A | 6/2010 |
| EP | 1477936 | | 11/2004 |
| TW | 502226 | | 9/2002 |
| TW | 579485 | | 3/2004 |
| TW | I231922 | | 5/2005 |
| TW | M326674 | | 2/2008 |
| TW | M376846 | | 3/2010 |

OTHER PUBLICATIONS

Saijie Lu, Tiejun He, Zhaohui Gao, "Design of Electronic Toll Collection System based on Global Positioning System Technique", 2009 ISECS International Colloquium on Computing, Communication, Control, and Management, CCCM 2009, p. 350-p. 353.

Wei-Hsun Lee, Bor-Shenn Jeng, Shian-Shyong Tseng, Ching-Hung Wang, "Electronic Toll Collection Based on Vehicle-Positioning System Techniques", Proceedings of the 2004 IEEE, International Conference on Networking, Sensing & Control, Taipei, Taiwan, Mar. 21-23, 2004, p. 643-p. 648.

Wern-Yarng Shieh, Wei-Hsun Lee, Shen-Lung Tung, and Chung-Ding Ho, "A Novel Architecture for Multilane-Free-Flow Electronic-Toll-Collection Systems in the Millimeter-Wave Range", IEEE Transactions on Intelligent Transportation Systems, vol. 6, No. 3, Sep. 2005, p. 294-p. 301.

Heinz Sodeikat, "Infrared Communication for Dynamic Route Guidance and Driver Information Services", Vehicle Navigation and Information Systems Conference, 1995. Proceedings. In conjunction with the Pacific Rim TransTech Conference., 1995 IEEE, p. 493-497.

"Office Action of Taiwan Counterpart Application", issued on Aug. 22, 2013, p. 1-p. 4.

"First Office Action of China Counterpart Application", issued on Nov. 19, 2013, p. 1-p. 9.

* cited by examiner

MULTI-LANE FREE FLOW ELECTRONIC TOLL COLLECTION SYSTEM AND ON BOARD UNIT THEREOF

CROSS-REFERENCE TO RELATED APPLICATION

This application claims the priority benefit of Taiwan application serial no. 99130097, filed on Sep. 6, 2010. The entirety of the above-mentioned patent application is hereby incorporated by reference herein and made a part of this specification.

TECHNICAL FIELD

The present disclosure generally relates to an electronic toll collection (ETC) system, and more particularly, to a multi-lane free flow ETC system and an on board unit (OBU) thereof.

BACKGROUND

In most existing highway toll collection systems around the world, vehicles are requested to stop at toll stations along the highway to pay tolls manually. Since the highway users have to stop their vehicles to pay the tolls at the toll stations and the transactions are carried out manually, the labor cost is kept high, time of the highway users is wasted, and air pollution is aggravated.

In addition, an automated ETC system may also be deployed over the lanes based on the dedicated short range communication (DSRC) protocol or the global positioning system (GPS) together with a mobile communication technique (for example, the general packet radio service (GPRS)) such that the ETC transactions can be automatically carried out.

However, because vehicles running in multiple lanes do not have to stick to specific lanes or slow down purposely, toll collection and law enforcement are made difficult. Thereby, multi-lane free flow ETC cannot be accomplished regardless of which ETC system (i.e., DSRC or GPS+GPRS)) is adopted.

SUMMARY

A multi-lane free flow electronic toll collection (ETC) system and an on board unit (OBU) thereof are introduced herein.

The present disclosure provides an ETC system including a toll collection module and an identification module. The toll collection module provides a pre-pay service and a post-pay service such that an OBU on a vehicle makes a toll payment in response to one of the pre-pay service and the post-pay service. The identification module captures an image of the vehicle and provides an identification service to the OBU to obtain an identification information of the vehicle.

The present disclosure further provides an OBU installed on a vehicle. The OBU determines whether a pre-pay service is received within a pre-pay communication range. When the pre-pay service is received within the pre-pay communication range, the OBU executes an intermittent pay procedure and determines whether an identification service is received. When the identification service is received, the OBU instantly and continuously sends the identification information of the vehicle for a predetermined time. When the identification service is not received, the OBU constantly executes the intermittent pay procedure until the vehicle exits the pre-pay communication range. After sending the identification information of the vehicle, the OBU determines whether the intermittent pay procedure succeeds. If the intermittent pay procedure succeeds, the OBU determines that the toll payment is completed. Otherwise, the OBU determines whether a post-pay service is received within a post-pay communication range. When the post-pay service is received within the post-pay communication range, the OBU executes an extended pay procedure to make the toll payment. When the post-pay service is not received within the post-pay communication range, the OBU continues to determine whether the post-pay service is received until the vehicle exits the post-pay communication range.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
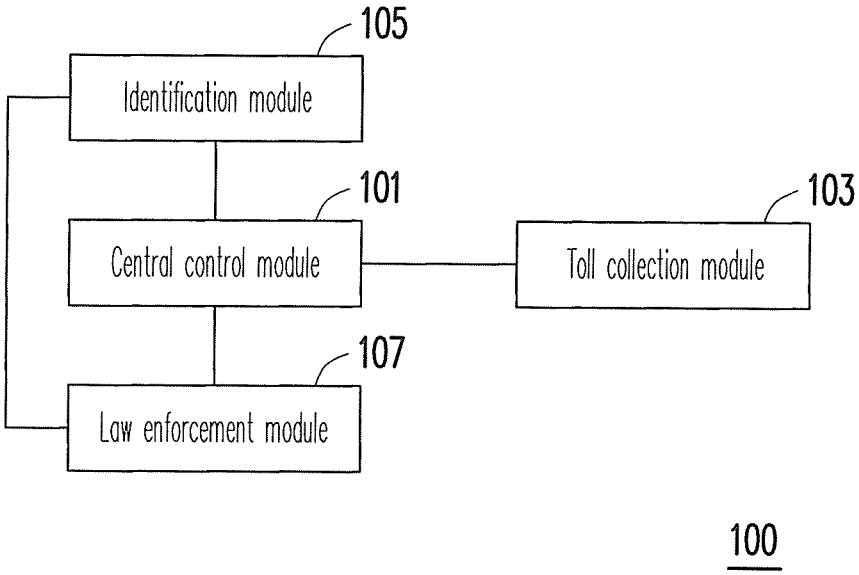
FIG. 1 is a block diagram of an electronic toll collection (ETC) system 100 according to an exemplary embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
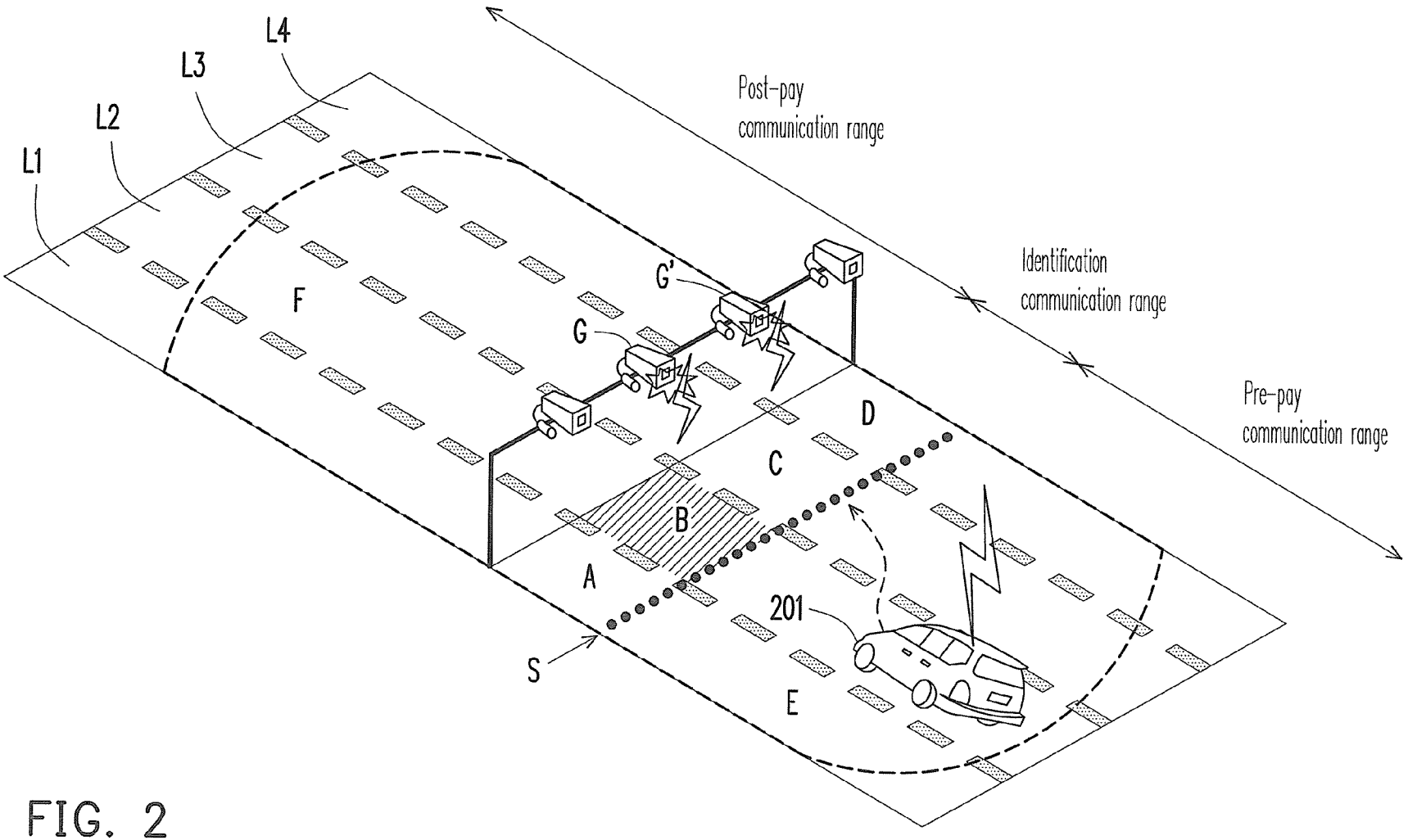
FIG. 2 is a diagram illustrating how the ETC system 100 in FIG. 1 is deployed on a tollway.

FIG. 1 is a block diagram of an electronic toll collection (ETC) system 100 according to an exemplary embodiment of the present disclosure, and FIG. 2 is a diagram illustrating how the ETC system 100 in FIG. 1 is deployed on a tollway. Referring to both FIG. 1 and FIG. 2, the ETC system 100 includes a central control module 101, a toll collection module 103, an identification module 105, and a law enforcement module 107. The central control module 101 guides the behaviours of the toll collection module 103, the identification module 105, and the law enforcement module 107. Namely, the operations of the toll collection module 103, the identification module 105, and the law enforcement module 107 are controlled by the central control module 101. The central control module 101 may be a powerful server system or workstation. However, the present disclosure is not limited thereto.

Under the control of the central control module 101, the toll collection module 103 provides a pre-pay service and a post-pay service (for example, provides the pre-pay service and the post-pay service within a relatively large area through a set of high-power omni antennas, but the present disclosure is not limited thereto), such that an on board unit (OBU) installed on a vehicle 201 that is running on a tollway (for example, a highway, but the present disclosure is not limited thereto) can make a toll payment in response to one of the pre-pay service and the post-pay service.

Under the control of the central control module 101, the identification module 105 captures an image of the vehicle 201 and provides an identification service to the OBU installed on the vehicle 201 (for example, provides the identification service within a relatively small area through one or multiple low-power directional antennas) to obtain identification information (at least the license plate and the model) of the vehicle 201. Herein each low-power directional antenna covers a communication area of the width of a lane. However, the present disclosure is not limited thereto.

When the identification module 105 obtains the identification information of the vehicle 201, under the control of the central control module 101, the law enforcement module 107 receives and links the image and the identification information of the vehicle 201 and records the linkage data between the image and the identification information of the vehicle 201 into a database. When the identification module 105 does not obtain the identification information of the vehicle 201 (no OBU is installed in the vehicle 201 or the OBU installed in the vehicle 201 fails), the law enforcement module 107 only receives and records the image of the vehicle 201 as a law enforcement evidence.

In the present exemplary disclosure, the toll collection module 103 provides the pre-pay service and the post-pay service to the OBU in the vehicle 201 within a first communication range (i.e., the range covered by the pre-pay communication range E and the post-pay communication range F in FIG. 2). In addition, the identification module 105 captures the image of the vehicle 201 and provides the identification service to the OBU in the vehicle 201 within a second communication range (i.e., the range covered by the identification communication ranges A-D in FIG. 2).

In other words, the first communication range contains the pre-pay communication range E and the post-pay communication range F, and the second communication range contains the identification communication ranges A-D, wherein the identification communication ranges A-D are corresponding to a plurality of isometric lanes L1-L4. Accordingly, the pre-pay communication range E covers all the identification communication ranges A-D. Namely, a part of the pre-pay communication range E overlaps the identification communication ranges A-D.

Thereby, when the vehicle 201 runs in the lane L2 of the tollway and enters the pre-pay communication range E, the central control module 101 controls the toll collection module 103 to provide the pre-pay service to the OBU in the vehicle 201 in a control channel (i.e., a channel 178) specified by a specific communication protocol (for example, the IEEE 1609 communication protocol, but the present disclosure is not limited thereto) according to the IEEE 1609 communication protocol, so that the OBU in the vehicle 201 executes an intermittent pay procedure in a pay service channel (for example, a channel 182, but the present disclosure is not limited thereto) among a plurality of (i.e., 6) service channels specified by the IEEE 1609 communication protocol in response to the pre-pay service.

Figure 3:
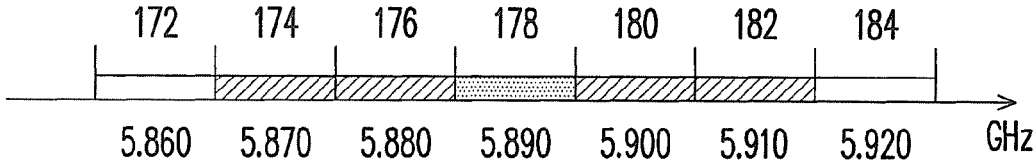
FIG. 3 is a diagram illustrating the frequency band of the IEEE 1609 communication protocol.
Figure 4:
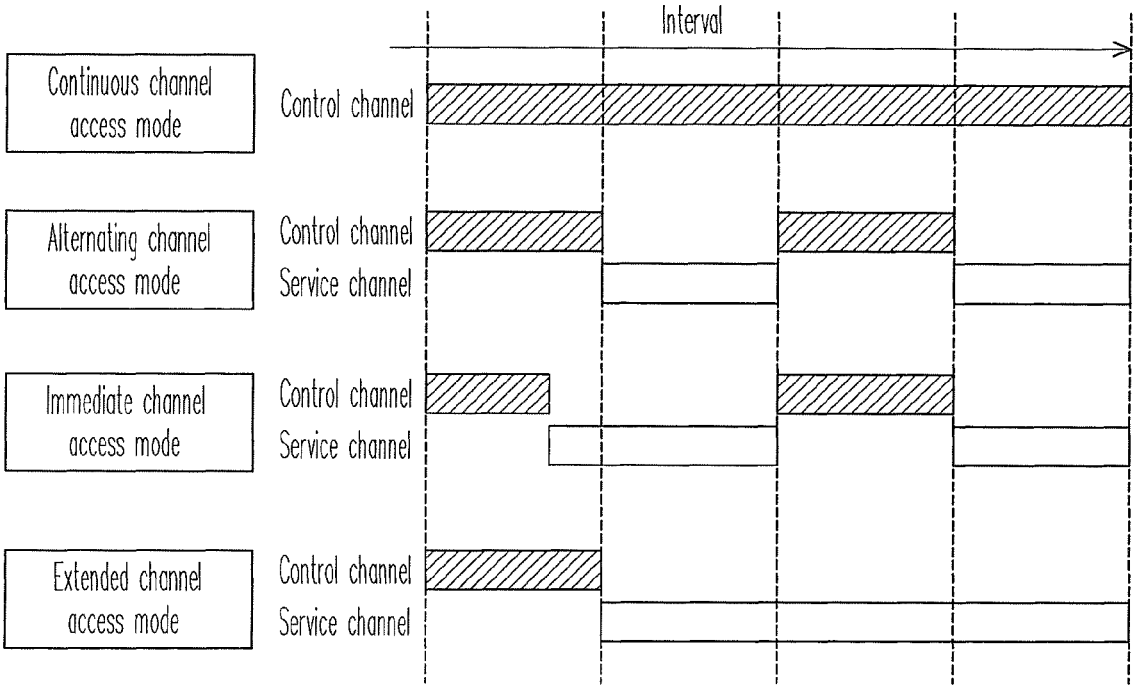
FIG. 4 is a diagram illustrating the channel access modes specified by the IEEE 1609 communication protocol.

Because the frequency of the control channel (i.e., the channel 178) is different from the frequencies of the 6 service channels (i.e., the channels 172, 174, 176, 180, 182, and 184) specified by the IEEE 1609 communication protocol (as shown in FIG. 3) and the IEEE 1609 communication protocol offers an alternating channel access mode (as shown in FIG. 4), once the OBU in the vehicle 201 detects the pre-pay service provided by the toll collection module 103 in the control channel (i.e., the channel 178) specified by the IEEE 1609 communication protocol, the OBU in the vehicle 201 makes the toll payment in the pay service channel (i.e., the channel 182) specified by the IEEE 1609 communication protocol.

In the present disclosure, because the pay service channel (i.e., the channel 182) specified by the IEEE 1609 communication protocol has limited service intervals, the OBU in the vehicle 201 may have to alternatively access the control channel (i.e., the channel 178) and the pay service channel (i.e., the channel 182) specified by the IEEE 1609 communication protocol for many times to complete the toll payment (or may not be able to complete the toll payment). This is what aforementioned "intermittent pay procedure" really means. However, the OBU in the vehicle 201 may also complete the toll payment by alternatively accessing the control channel (i.e., the channel 178) and the pay service channel (i.e., the channel 182) specified by the IEEE 1609 communication protocol for only once. This is determined by the communication network environment.

In the present exemplary embodiment, when the intermittent pay procedure executed by the OBU in the vehicle 201 within the pre-pay communication range E succeeds, the toll payment is completed. Contrarily, when the intermittent pay procedure executed by the OBU in the vehicle 201 within the pre-pay communication range E fails, the toll payment is not completed. Herein the OBU in the vehicle 201 has to be able to determine whether the intermittent pay procedure executed within the pre-pay communication range E succeeds or fails.

Thereafter, at the instant when the vehicle 201 running in the lane L2 of the tollway passes through a plurality of sensors S that are arranged into a straight line and mounted over the lanes L1-L4 (as the position indicated by the dotted line in FIG. 2, which may be considered as a part of the identification module 105, and the vehicle 201 may be sensed through one or a combination of microwave, optical, and pressure sensing techniques), the identification module 105 notifies the central control module 101 through the sensors S that the vehicle 201 is entering the identification communication range B (assuming the vehicle 201 is running in the lane L2). However, if the vehicle 201 changes to lane L3 before it enters the identification communication range B, the identification module 105 notifies the central control module 101 through the sensors S that the vehicle 201 is entering the identification communication range C.

Thus, the central control module 101 instantly controls the identification module 105 to trigger any device G (i.e., the vehicle 201 remains in the lane L2) or device G' (i.e., the vehicle 201 changes to the lane L3) that can take photos to capture an image of the vehicle 201, wherein the devices G and G' may be cameras, CCD image sensors, or CMOS image sensors (however, the present disclosure is not limited thereto) and are considered as a part of the identification module 105, and the two devices G and G' are capable of capturing an image of three vehicles running in parallel within two lanes. Herein the central control module 101 also controls the identification module 105 to provide the identification service to the OBU in the vehicle 201 in the control channel (i.e., the channel 178) specified by the IEEE 1609 communication protocol according to the IEEE 1609 communication protocol, so that the OBU in the vehicle 201 sends the identification information (i.e., the license plate and the model) of the vehicle 201 to the identification module 105 in one of a plurality of identification service channels (except the channel 182, for example, the channel 176) among the 6 service channels (i.e., the channels 172, 174, 176, 180, 182, and 184) specified by the IEEE 1609 communication protocol in response to the identification service On the other hand, even if the vehicle 201 changes to the identification communication range C of the lane L3 after it enters the identification communication range B of the lane L2, since the identification module 105 already provides the identification service to the OBU in the vehicle 201 within identification communication range B, the OBU in the vehicle 201 still sends the identification information of the vehicle 201 to the identification module 105 in the identification service channel (i.e., the channel 176) specified by the IEEE 1609 communication protocol in response to the identification service. In other words, regardless of how the vehicle 201 changes lanes, the OBU in the vehicle 201 always sends the identification information of the vehicle 201 in an identification service channel appointed by the identification module 105.

In the present exemplary disclosure, when the vehicle 201 remains in the lane L2 and enters an overlap area (i.e., the area indicated with diagonal lines in FIG. 2) between the pre-pay communication range E and the identification communication range B, the priority of the identification service provided by the identification module 105 in the control channel (i.e., the channel 178) specified by the IEEE 1609 communication protocol is higher than that of the pre-pay service provided by the toll collection module 103 in the control channel (i.e., the channel 178) specified by the IEEE 1609 communication protocol. Accordingly, the central control module 101 can schedule (or is capable of scheduling) the pre-pay service and the identification service.

Additionally, because the IEEE 1609 communication protocol offers an immediate channel access mode (as shown in FIG. 4), once the OBU in the vehicle 201 receives the identification service provided by the identification module 105 within the overlap area (i.e., the area indicated with diagonal lines in FIG. 2), the OBU in the vehicle 201 instantly sends the identification information of the vehicle 201 to the identification module 105 in the corresponding identification service channel (i.e., the channel 176) in response to the identification service until a predetermined time (determined according to the actual requirement). Namely, the OBU in the vehicle 201 does not detect/monitor the service provided in the control channel (i.e., the channel 178) specified by the by the IEEE 1609 communication protocol during this predetermined time. In other words, the OBU in the vehicle 201 starts to detect the service provided in the control channel (i.e., the channel 178) specified by the IEEE 1609 communication protocol once this predetermined time is passed.

It should be mentioned herein that different OBUs in adjacent lanes respectively send the identification information of different vehicles to the identification module 105 in different identification service channels in response to the same identification service provided by the identification module 105. For example, the OBUs respectively installed in three vehicles that are respectively running in the lanes L1-L3 respectively send the identification information of the vehicles to the identification module 105 in three different identification service channels (for example, the channels 174, 176, and 180) specified by the IEEE 1609 communication protocol. In other words, identification information of vehicles running in adjacent lanes can be sent to the identification module 105 in different identification service channels so that competition behaviors between the vehicles for sending the identification information are avoided.

Accordingly, when the identification module 105 captures the image of the vehicle 201 and obtains the identification information of the vehicle 201, the central control module 101 controls the law enforcement module 107 to receive and link the image and the identification information of the vehicle 201 (i.e., a mapping relationship exists between the image and the identification information of the vehicle 201) and record the linkage data. Contrarily, when the identification module 105 does not obtain the identification information of the vehicle 201, the central control module 101 controls the law enforcement module 107 to receive and record the image of the vehicle 201 as a law enforcement evidence.

Subsequently, when the vehicle 201 enters the post-pay communication range F from the identification communication range B, if the OBU in the vehicle 201 has completed the toll payment within the pre-pay communication range E, it does not monitor/detect/response to the post-pay service provided by the toll collection module 103 in the control channel (i.e., the channel 178) specified by the IEEE 1609 communication protocol under the control of the central control module 101 according to the IEEE 1609 communication protocol.

However, if the OBU in the vehicle 201 does not complete the toll payment within the pre-pay communication range E, it would monitor/detect/respond to the post-pay service provided by the toll collection module 103 in the control channel (i.e., the channel 178) specified by the IEEE 1609 communication protocol under the control of the central control module 101 according to the IEEE 1609 communication protocol. Accordingly, the OBU in the vehicle 201 executes an extended pay procedure in the pay service channel (i.e., the channel 182) specified by the IEEE 1609 communication protocol in response to the post-pay service to complete the toll payment.

Because the IEEE 1609 communication protocol offers an extended channel access mode (as shown in FIG. 4), once the OBU in the vehicle 201 detects the post-pay service provided by the toll collection module 103 in the control channel (i.e., the channel 178) specified by the IEEE 1609 communication protocol, it makes the toll payment in the pay service channel (i.e., the channel 182) specified by the IEEE 1609 communication protocol.

Besides, because the pay service channel (i.e., the channel 182) specified by the IEEE 1609 communication protocol has longer service intervals in the extended channel access mode (because the OBU in the vehicle 201 needs not to detect any service provided in the control channel (i.e., the channel 178) specified by the IEEE 1609 communication protocol), the OBU in the vehicle 201 wholeheartedly commits itself to make the toll payment in the pay service channel (i.e., the channel 182) specified by the IEEE 1609 communication protocol (i.e., more time is assigned to the OBU in the vehicle 201 to make the toll payment). This is what aforementioned "extended pay procedure" really means. However, if the OBU in the vehicle 201 still cannot complete the toll payment within the post-pay communication range F, a law enforcement agency has to use the image of the vehicle 201 recorded in the law enforcement module 107 as a law enforcement evidence.

Based on the exemplary embodiment described above, the ETC system 100 communicates with the OBU in the vehicle 201 within a relatively large communication range (the pre-pay communication range E and the post-pay communication range F) to make the OBU in the vehicle 201 to make a payment. Additionally, the ETC system 100 communicates with the OBU in the vehicle 201 within a relatively small communication range (the identification communication ranges A-D) to capture the image of the vehicle 201 and obtain the identification information of the vehicle 201.

Thereby, the ETC system 100 not only achieves the purpose of multi-lane free flow ETC (a vehicle does not have to stick to a specific lane (i.e., can change lanes freely) or purposely slow down), but also links the images and identification information of vehicles precisely so that the efficiency and public credit of the law enforcement agency are improved (regarding those vehicles that run on tollways but do not make payment). Moreover, since the multi-lane free flow ETC and law enforcement are realized in the ETC system 100 according to a single open international standard communication protocol (i.e., the IEEE 1609 communication protocol), the development of tollway-related industries between different countries is facilitated.

It should be mentioned herein that even though in foregoing exemplary embodiment, the ETC system 100 communicates with the OBU in the vehicle 201 based on the IEEE 1609 communication protocol, in other exemplary embodiments, the ETC system 100 may also communicate with the OBU in the vehicle 201 based on other multi-channel network protocols, and such variations are also within the scope of the present disclosure.

Figure 5:
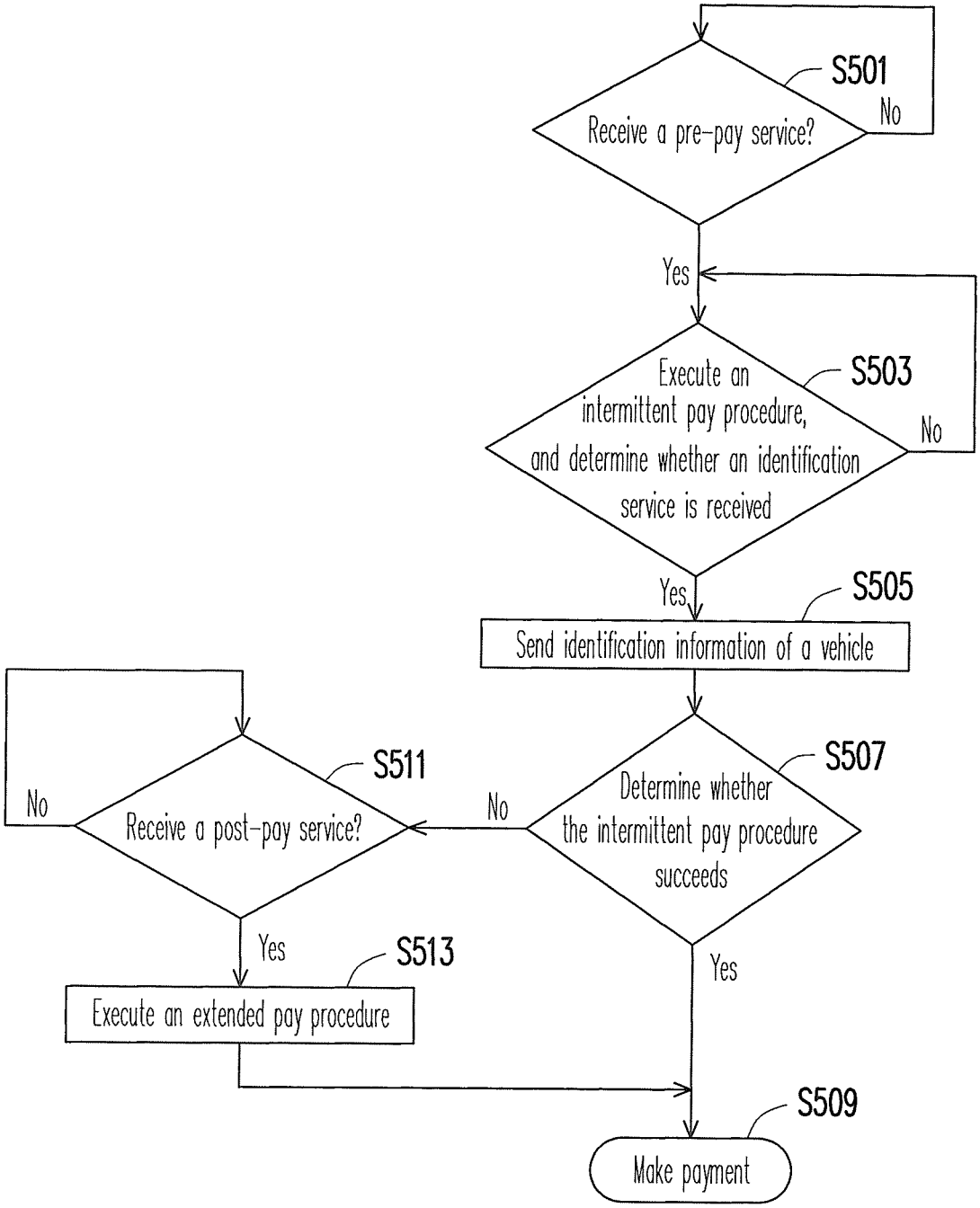
FIG. 5 is a flowchart illustrating the operation of an on board unit (OBU) installed on a vehicle 201 according to an exemplary embodiment of the present disclosure.

On the other hand, as described in foregoing exemplary embodiments, the operation flow of the configured OBU in the vehicle 201 is illustrated in FIG. 5. In other words, the configured OBU in the vehicle 201 executes following steps.

The OBU in the vehicle 201 determines whether a pre-pay service is received within a pre-pay communication range (step S501).

When the pre-pay service is received within the pre-pay communication range, the OBU in the vehicle 201 executes an intermittent pay procedure and determines whether an identification service is received (step S503).

When the identification service is received, the OBU in the vehicle 201 instantly and constantly send the identification information of the vehicle until a predetermined time elapses (determined according to the actual requirement) (step S505). When the identification service is not received, the OBU in the vehicle 201 continues to execute the intermittent pay procedure until the vehicle 201 exits the pre-pay communication range.

After sending the identification information of the vehicle, the OBU in the vehicle 201 determines whether the intermittent pay procedure succeeds (step S507).

If the intermittent pay procedure succeeds, the OBU in the vehicle 201 completes the toll payment (step S509). Otherwise, the OBU in the vehicle 201 deter nines whether a post-pay service is received within a post-pay communication range (step S511).

When the post-pay service is received within the post-pay communication range, the OBU in the vehicle 201 executes an extended pay procedure (step S513) to complete the toll payment. When the post-pay service is not received within the post-pay communication range, the OBU in the vehicle 201 continuous to determine whether the post-pay service is received until the vehicle 201 exits the post-pay communication range.

Thereby, the priority of the OBU in the vehicle 201 sending the identification information of the vehicle in response to the identification service is higher than that of the OBU in the vehicle 201 executing the intermittent pay procedure in response to the pre-pay service. In short, the OBU in the vehicle 201 must be given precedence to send the identification information of the vehicle 201 over it makes the toll payment. Accordingly, the law enforcement agency can prosecute according to the identity of the vehicle 201 even if the OBU in the vehicle 201 does not make the toll payment.

Figure 6:
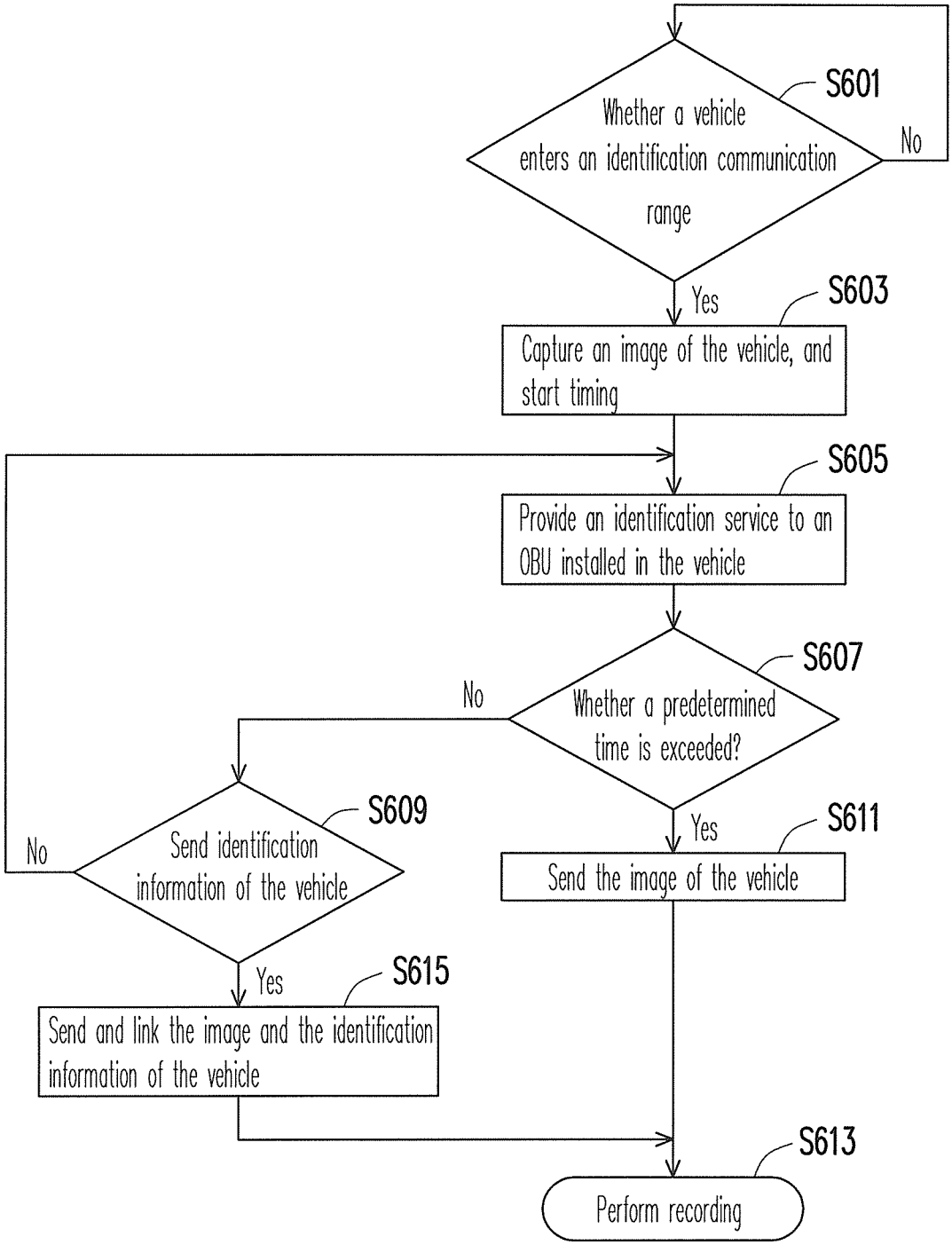
FIG. 6 is a flowchart illustrating the operations of an identification module 105 and a law enforcement module 107 of the ETC system 100 according to an exemplary embodiment of the present disclosure.

On the other hand, as described in foregoing exemplary embodiments, the operation flow of the configured identification module 105 and the configured law enforcement module 107 of the ETC system 100 is illustrated in FIG. 6. In other words, the configured identification module 105 and the configured law enforcement module 107 of the ETC system 100 execute following steps.

Whether a vehicle enters an identification communication range is determined (step S601).

Once the vehicle enters the identification communication range, an image of the vehicle is captured by using an image-capturing device, and timing starts (step S603). Otherwise, whether the vehicle enters the identification communication range is continuously detected.

An identification service is provided to an OBU installed in the vehicle at the same/next time (step S605), and whether a predetermined time is passed is determined (step S607).

If it is determined in step S607 that the predetermined time is not passed, whether the OBU in the vehicle sends the identification information of the vehicle is determined (step S609). Otherwise, the image of the vehicle is transmitted (step S611) and recorded (step S613).

If the OBU in the vehicle does not send the identification information of the vehicle, the identification service is continuously provided to the OBU in the vehicle until the predetermined time elapses. Otherwise, the image and the identification information of the vehicle are transmitted and linked (step S615), and the linkage data is recorded (step S613).

In summary, the ETC system 100 in an exemplary embodiment of the present disclosure has at least following points:

1. services respectively provided by the toll collection module and the identification module can be scheduled so that a vehicle can receive the services at appropriate time;

2. OBUs in different vehicles respectively send identification information of the vehicles in response to the same identification service through different service channels, so that communication conflict is avoided, the success rates of the services are improved, and vehicles are allowed to change lanes freely, which conforms to the multi-lane free flow concept;

3. multi-lane free flow ETC and law enforcement is accomplished according to a single open international standard communication protocol (i.e., the IEEE 1609 communication protocol), so that the development of tollway-related industries between different countries is facilitated;

4. the identification module communicates with the OBU in the vehicle through different service channels in different lanes, and the OBU in the vehicle may adopt a communication pattern with an omni antenna instead of directional antennas; and 5. the toll collection module and the identification module cooperate with each other to improve the success rate of the ETC system and effectively use the characteristics of the microwave broad-field communication technology.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electronic toll collection (ETC) system, comprising:

a central control module comprising a processor;

a toll collection module guided by the processor, and configured for providing a pre-pay service and a post-pay service, wherein an on board unit (OBU) on a vehicle makes a toll payment in response to one of the pre-pay service and the post-pay service; and an identification module guided by the processor, and configured for capturing an image of the vehicle and providing an identification service to the OBU to obtain an identification information of the vehicle, wherein when the vehicle enters a pre-pay communication range, the OBU executes an intermittent pay procedure in response to the pre-pay service, wherein when the intermittent pay procedure executed by the OBU within the pre-pay communication range fails and the vehicle enters a post-pay communication range from the pre-pay communication range, the OBU executes an extended pay procedure in response to the post-pay service to make the toll payment, wherein the toll collection module further provides the pre-pay service and the post-pay service within a first communication range, and the identification module further captures the image of the vehicle and provides the identification service to the OBU within a second communication range, wherein the first communication range comprises the pre-pay communication range and the post-pay communication range, the second communication range comprises a plurality of identification communication ranges, and the identification communication ranges are corresponding to a plurality of isometric lanes, wherein the pre-pay communication range covers the identification communication ranges, wherein when the vehicle enters an overlap area of the pre-pay communication range and the identification communication ranges, a priority of the identification service provided by the identification module in a control channel specified by a specific communication protocol according to the specific communication protocol is higher than a priority of the pre-pay service provided by the toll collection module in the control channel, and when the OBU receives the identification service provided by the identification module within the overlap area, the OBU instantly sends the identification information of the vehicle to the identification module in one corresponding of a plurality of identification service channels among a plurality of service channels specified by the specific communication protocol in response to the identification service.

2. The ETC system according to claim 1 further comprising:

a law enforcement module guided by the processor, and configured for receiving and linking the image and the identification information of the vehicle and recording a linkage data when the identification module obtains the identification information of the vehicle, and for receiving and recording the image of the vehicle as a law enforcement evidence when the identification module does not obtain the identification information of the vehicle.

3. The ETC system according to claim 2, wherein when the vehicle enters the pre-pay communication range, the central control module controls the toll collection module to provide the pre-pay service to the OBU in the control channel specified by the specific communication protocol according to the specific communication protocol, so that the OBU executes the intermittent pay procedure in a pay service channel among the plurality of service channels specified by the specific communication protocol in response to the pre-pay service.

4. The ETC system according to claim 3, wherein a frequency of the control channel is different from frequencies of the service channels.

5. The ETC system according to claim 4, wherein when the vehicle enters one of the identification communication ranges, the central control module controls the identification module to capture the image of the vehicle, and the central control module further controls the identification module to provide the identification service to the OBU in the control channel according to the specific communication protocol, so that the OBU sends the identification information of the vehicle to the identification module in the one of the plurality of identification service channels among the service channels in response to the identification service.

6. The ETC system according to claim 5, wherein different OBUs at adjacent lanes respectively send identification information of different vehicles to the identification module in different ones of the identification service channels in response to the identification service provided by the identification module.

7. The ETC system according to claim 5, wherein when the intermittent pay procedure executed by the OBU within the pre-pay communication range succeeds, the toll payment is completed.

8. The ETC system according to claim 5, wherein when the intermittent pay procedure executed by the OBU within the pre-pay communication range fails and the vehicle enters the post-pay communication range from the identification communication ranges, the central control module controls the toll collection module to provide the post-pay service to the OBU in the control channel according to the specific communication protocol, so that the OBU executes the extended pay procedure in the pay service channel in response to the post-pay service to make the toll payment.

9. The ETC system according to claim 5, wherein when the identification module captures the image of the vehicle and obtains the identification information of the vehicle, the central control module controls the law enforcement module to receive and link the image and the identification information of the vehicle and record the linkage data, and when the identification module does not obtain the identification information of the vehicle, the central control module controls the law enforcement module to receive and record the image of the vehicle as a law enforcement evidence.

10. The ETC system according to claim 1, wherein the specific communication protocol at least comprises an IEEE 1609 communication protocol or a multi-channel network protocol.

* * * * *